US009243477B2

(12) United States Patent
Solenthaler

(10) Patent No.: US 9,243,477 B2
(45) Date of Patent: Jan. 26, 2016

(54) SYSTEM AND METHOD FOR ULTRASONICALLY TREATING LIQUIDS IN WELLS AND CORRESPONDING USE OF SAID SYSTEM

(75) Inventor: Peter Solenthaler, St. Margarethen (CH)

(73) Assignee: Progress Ultrasonics AG, Zug (CH)

( * ) Notice: Subject to any disclaimer, the term of this patent is extended or adjusted under 35 U.S.C. 154(b) by 73 days.

(21) Appl. No.: 13/521,206

(22) PCT Filed: Feb. 7, 2011

(86) PCT No.: PCT/EP2011/051745

§ 371 (c)(1),
(2), (4) Date: Jul. 9, 2012

(87) PCT Pub. No.: WO2011/098422

PCT Pub. Date: Aug. 18, 2011

(65) Prior Publication Data

US 2012/0305240 A1 Dec. 6, 2012

(30) Foreign Application Priority Data

Feb. 12, 2010 (EP) ..... 10153415

(51) Int. Cl.
*E21B 43/00* (2006.01)
*E21B 28/00* (2006.01)
*G10K 11/02* (2006.01)

(52) U.S. Cl.
CPC ..... *E21B 43/003* (2013.01); *E21B 28/00* (2013.01); *G10K 11/02* (2013.01)

(58) Field of Classification Search
CPC ..... E21B 43/003; E21B 28/00; H01L 41/083; H01L 41/09; H01L 41/042; H03H 9/09; H03H 9/0595; F16F 15/005; G10K 11/002; B06B 1/0685; B06B 1/0622
USPC ..... 166/249, 177.1, 177.2, 177.6
See application file for complete search history.

(56) References Cited

U.S. PATENT DOCUMENTS

| | | | | |
|---|---|---|---|---|
| 2,871,943 | A * | 2/1959 | Bodine, Jr. | 166/249 |
| 3,322,196 | A | 5/1967 | Bodine, Jr. | |
| 3,628,071 | A * | 12/1971 | Harris et al. | 74/15.4 |
| 3,674,945 | A * | 7/1972 | Hands | 381/111 |
| 3,842,907 | A * | 10/1974 | Baker et al. | 166/249 |
| 3,990,512 | A * | 11/1976 | Kuris | 166/249 |
| 4,004,165 | A * | 1/1977 | Bredael et al. | 310/317 |
| 4,366,406 | A * | 12/1982 | Smith et al. | 310/334 |
| 4,537,511 | A | 8/1985 | Frei | |
| 4,792,930 | A * | 12/1988 | Kobayashi et al. | 367/140 |
| 4,829,316 | A * | 5/1989 | Nakasa et al. | 343/792 |
| 5,109,922 | A * | 5/1992 | Joseph | 166/65.1 |

(Continued)

FOREIGN PATENT DOCUMENTS

| | | |
|---|---|---|
| EP | 44 800 | 1/1982 |
| WO | 93/11338 | 6/1993 |
| WO | 2005/090746 | 9/2005 |

*Primary Examiner* — Jennifer H Gay
(74) *Attorney, Agent, or Firm* — Davis & Bujold, P.L.L.C.; Michael J. Bujold

(57) ABSTRACT

A treatment device for treating liquids in oil, gas or water wells comprises an ultrasonic treatment device (1). The ultrasonic treatment device (1) includes a resonator (2), a transducer (9) and a matching transformer (10) for transferring a maximum of power from an ultrasonic generator to the transducer (9) through a long cable (11). The cable (11) has a considerable length of at least 3 km and is attached to a generator (5).

9 Claims, 3 Drawing Sheets

(56) References Cited

U.S. PATENT DOCUMENTS

| | | | | | |
|---|---|---|---|---|---|
| 5,137,109 | A * | 8/1992 | Dorel | 181/106 |
| 5,146,050 | A * | 9/1992 | Strozeski et al. | 181/102 |
| 5,184,678 | A * | 2/1993 | Pechkov et al. | 166/249 |
| 5,200,666 | A * | 4/1993 | Walter et al. | 310/323.01 |
| 5,282,508 | A * | 2/1994 | Ellingsen et al. | 166/249 |
| 5,344,532 | A * | 9/1994 | Joseph | 204/157.15 |
| 5,418,335 | A * | 5/1995 | Winbow | 181/106 |
| 5,592,438 | A * | 1/1997 | Rorden et al. | 367/83 |
| 5,635,685 | A * | 6/1997 | Tierce et al. | 181/106 |
| 5,850,369 | A * | 12/1998 | Rorden et al. | 367/83 |
| 5,950,726 | A * | 9/1999 | Roberts | 166/249 |
| 5,995,449 | A * | 11/1999 | Green et al. | 367/83 |
| 6,012,521 | A * | 1/2000 | Zunkel et al. | 166/249 |
| 6,135,234 | A * | 10/2000 | Harris et al. | 181/106 |
| 6,166,998 | A * | 12/2000 | Hare et al. | 367/176 |
| 6,186,228 | B1 | 2/2001 | Wegener et al. | |
| 6,208,586 | B1 * | 3/2001 | Rorden et al. | 367/35 |
| 6,310,829 | B1 * | 10/2001 | Green et al. | 367/82 |
| 6,390,191 | B1 * | 5/2002 | Melson et al. | 166/177.1 |
| 6,405,796 | B1 * | 6/2002 | Meyer et al. | 166/249 |
| 6,450,258 | B2 * | 9/2002 | Green et al. | 166/250.17 |
| 6,460,618 | B1 * | 10/2002 | Braithwaite et al. | 166/249 |
| 6,474,349 | B1 * | 11/2002 | Laker | 134/22.12 |
| 6,491,095 | B2 * | 12/2002 | Kompanek | 166/249 |
| 6,619,394 | B2 * | 9/2003 | Soliman et al. | 166/249 |
| 6,763,883 | B2 * | 7/2004 | Green et al. | 166/250.17 |
| 6,968,910 | B2 * | 11/2005 | Bar-Cohen et al. | 175/56 |
| 6,973,972 | B2 | 12/2005 | Aronstam | |
| 7,213,681 | B2 * | 5/2007 | Birchak et al. | 181/121 |
| 7,216,738 | B2 * | 5/2007 | Birchak et al. | 181/121 |
| 7,606,592 | B2 * | 10/2009 | Becker | 455/523 |
| 7,823,638 | B2 * | 11/2010 | Ellingsen | 166/177.2 |
| 8,113,278 | B2 * | 2/2012 | DeLaCroix et al. | 166/249 |
| 8,613,312 | B2 * | 12/2013 | Zolezzi-Garreton | 166/248 |
| 2001/0011590 | A1 * | 8/2001 | Thomas et al. | 166/248 |
| 2001/0043509 | A1 * | 11/2001 | Green et al. | 367/81 |
| 2003/0015319 | A1 * | 1/2003 | Green et al. | 166/250.01 |
| 2003/0018260 | A1 * | 1/2003 | Erikson | 600/447 |
| 2003/0116355 | A1 * | 6/2003 | Bar-Cohen et al. | 175/56 |
| 2005/0022987 | A1 * | 2/2005 | Green et al. | 166/250.17 |
| 2009/0194296 | A1 * | 8/2009 | Gillan et al. | 166/385 |
| 2009/0251993 | A1 * | 10/2009 | Berris et al. | 367/29 |
| 2011/0139440 | A1 * | 6/2011 | Zolezzi-Garreton | 166/249 |
| 2012/0305240 | A1 * | 12/2012 | Solenthaler | 166/249 |

* cited by examiner

SYSTEM AND METHOD FOR ULTRASONICALLY TREATING LIQUIDS IN WELLS AND CORRESPONDING USE OF SAID SYSTEM

BACKGROUND OF THE INVENTION

The invention relates to the use of an ultrasonic transducer, to a system for treating liquids in wells and to a method for treating liquids in such wells according to the preamble of the independent patent claims.

It is known to treat liquids in wells such as gas, oil or water wells with ultrasonic energy in order to reduce the viscosity of the liquid without the use of chemical reagents or steam generators. Such use of ultrasonic energy e.g. has been disclosed in WO 2005/090746A1, WO 93/11338 or U.S. Pat. No. 6,973,972. The effect of reduction of viscosity is due to cavitation effects induced in the liquid by ultrasonic vibrations.

All these known solutions, however, have certain drawbacks. In particular, there are problems in context with transmission of ultrasonic energy to bore wells over relatively high distances which typically may be greater than several kilometers. Also, known devices have a poor efficiency.

SUMMARY OF THE INVENTION

It is therefore an object of the present invention to overcome the drawbacks of the prior art, in particular to provide a system and a method for treating liquids in gas, oil or water wells which can be used also in deep wells and which has a high efficiency for treating the liquid, in particular for reducing its viscosity.

According to the invention, these and other objects are solved with the use of an ultrasonic transducer, a system and a method for treating liquids according to the independent patent claims.

It has been found that the use of an ultrasonic transducer with a resonator connected thereto where at least one end of the resonator is connected to a front surface of the transducer at the point of longitudinal oscillation maximum and where the length of the resonator is tuned to an integer multiple of a half acoustic length of the longitudinal oscillation of the transducer is particularly efficient for treatment of liquids in wells such as gas, oil or water wells. Such resonators are known per se in the art e.g. as shown in EP 44 800 A2, the content of which is incorporated herein by reference.

According to a preferred embodiment the resonator is tubular or a solid round rod. It is, however, also conceivable to have non tubular resonators such as resonators with a polygonal cross section or—depending on the shape and size of the well to be treated—resonators with an overall conical shape or resonators with a wave like outer shape. However, care should be taken that the resonator is properly tuned to the resonance frequency of the transducer.

In particular, an ultrasonic transducer with a resonator is used, where the transducer is additionally provided with a means for adapting the power to the impedance, in particular an impedance matching transformer for up converting the voltage of an incoming ultrasonic signal. In case of transmission of ultrasonic energy over relatively large distances, e.g. over cables having a length of more than 3 km, high losses will occur in the cable. With this matching transformer the energy supplied to the transducer is maximum by adaptation to the impedance of the cable and the device formed by the transducer with the resonator.

Accordingly a further aspect of the invention is directed to a system for treating liquids in gas, oil or water wells. The system comprises an ultrasonic treatment device. The ultrasonic treatment device has a transducer with a resonator connected thereto. At least one end of the resonator is connected to a front surface of the transducer at the point of longitudinal oscillation maximum. The length of the resonator is tuned to an integer multiple of half an acoustic length of the longitudinal oscillation fed from the transducer to the resonator. According to the invention, the system comprises a generator for generating ultrasonic power. The signal are generated at a relatively high voltage. The system further comprises a long cable for connecting the generator to the treatment device. The device further comprises means for adapting the generator to the impedance of the cable, the transducer and the resonator, in particular a matching network transformer to transfer a maximum of generator power to the transducer in the well. In a preferred embodiment the resonator is tubular. Other shapes are possible depending on the use.

According to a further preferred embodiment the transformer or the matching impedance network adapting means is directly attached to the tubular resonator. Therewith, one integral device can be formed which easily can be placed in a well, e.g. by attaching it to a mechanical cable. The matching transformer is integrated in the device so that there is no need for additional connectors or cables which could be damaged during use. Typically the cable has a length of more than 3 km, preferably around 6 to 8 km.

Preferably, an ultrasonic frequency of 5 to 25 kHz with a voltage of up to 2 kV will lead to the transducer in the well.

According to a further preferred embodiment of the invention, there is provided a set of different resonators having different shapes which can be chosen depending from the geometry of the well or depending from the composition of the liquid to be treated. Typically, the set comprises at least two resonators having a different shape, preferably around eight different sizes and/or shapes.

BRIEF DESCRIPTION OF THE DRAWINGS

The invention will now be explained in more detail with reference to the drawings which show.

DESCRIPTION OF THE PREFERRED EMBODIMENT

Figure 1:
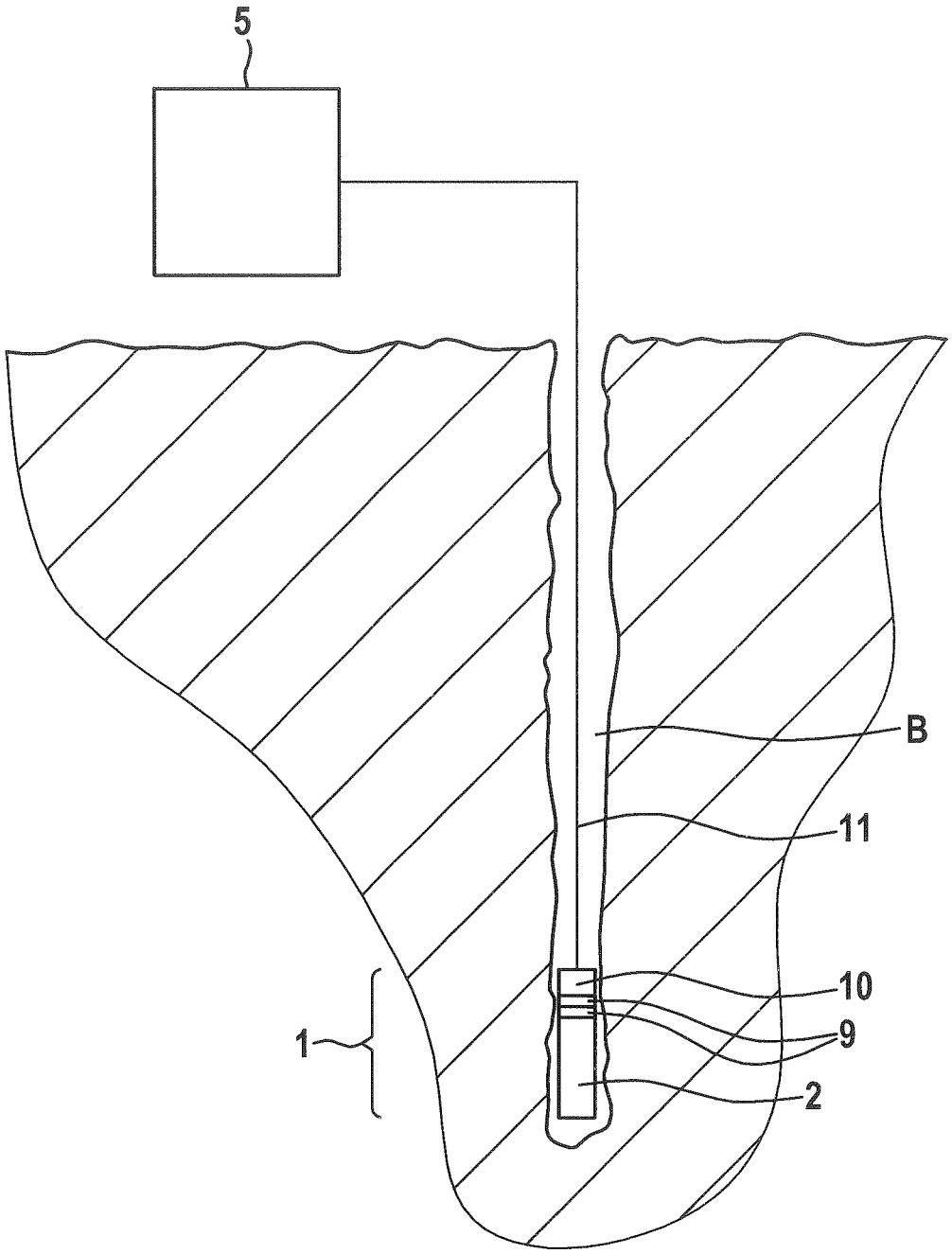
FIG. 1 a schematic overview of a device according to the invention.

FIG. 1 schematically shows an ultrasonic treating device 1 arranged in a bore well B. The ultrasonic treatment device 1 substantially consists of a resonator 2, a transducer 9 and a matching transformer 10. The transducer 9 is attached to one end of the resonator. The transformer 10 is integrally attached to the resonator 2 e.g. by welding or through screw connections. A long cable 11 is connecting the treatment device 1 and in particular its transformer 10 with an ultrasonic generator 5. The ultrasonic generator 5 is a generator basically known to a skilled person and generating ultrasonic energy with a frequency of approx. 20 kHz and with a maximum voltage/amplitude of 2 kV. The cable 11 typically has a length up to 7 km. In view of the high length of the cable, the transformer 10 is used to up convert the amplitude of the incoming signal.

The transformer is designed in such a way as to adapt the vibrating amplitude in the transducer to create a high cavitation on device 1 for the treatment.

Figure 2:
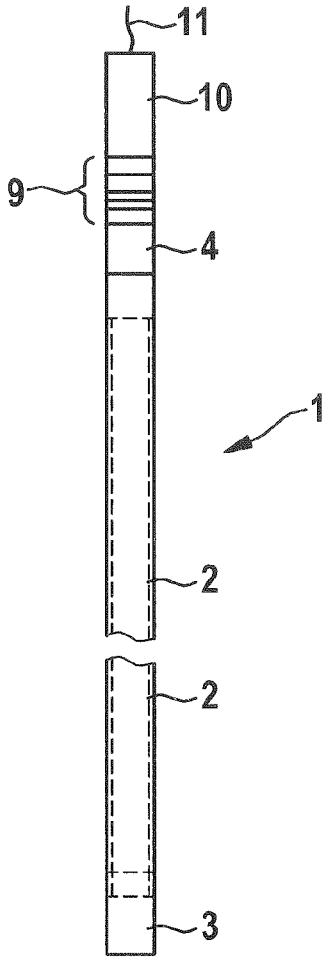
FIG. 2 an enlarged view of the treatment device as shown in FIG. 1.

The treatment device 1 is shown in more detail in FIG. 2. The treatment device 1 has a tubular resonator 2. The open ends of the tubular resonator 2 are closed with an acoustic transformer 3 and an acoustic transformer piece 4. Attached to the front end formed by the transformer piece 4 there is arranged a piezoelectric transducer 9. These parts of the treatment device are formed substantially identically as the one shown in EP 44 800 A2. In particular, the length of the device is adapted to the wave length of operation and to the resonance frequency of the transducer 9. Typically, the length of the resonator corresponds to an integer multiple of half a wave length ($\lambda/:2$).

The transformer 10 is arranged in a metal casing which is attached to the resonator 2 through mechanical connections such as welds or screws. In operation, the resonator 2 is generating ultrasonic waves which are radially distributed around the resonator. Because of cavitation in the fluid, the viscosity of the fluid, in particular of oil is reduced.

Figure 3:
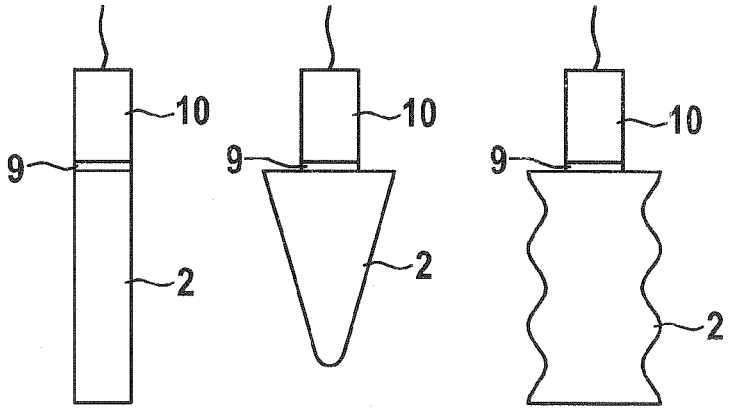
FIG. 3 a set with three treatment devices having different shapes.

Depending on the specific circumstances, other resonators may be used. In particular, the resonator may be formed of a rod (not hollow) or may have a rectangular or other polygonal cross section. Also, it is possible to use two transducers arranged on both sides (seen in the axial direction) of the resonator in order to have a "push-pull" operation. As schematically shown in FIG. 3, depending on the specific requirements, other shapes of resonators 2 can be used e.g. conically shaped resonators or resonators having a wave like outer surface. In the embodiment as shown in FIG. 3, all resonators have a round cross section in plane perpendicular to the axis.

Figure 4:
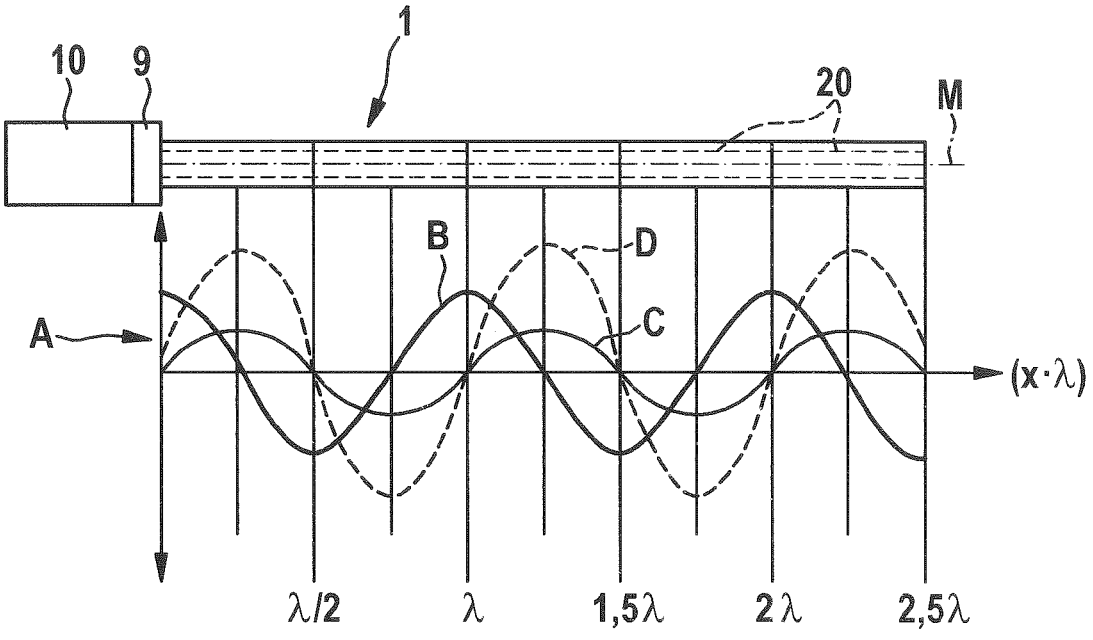
FIG. 4 a schematic view of an ultrasonic treating device.

FIG. 4 shows the amplitude pattern at the resonator 1 which, in a notional model, is divided into individual transducer sections 20. The amplitude is shown on the vertical axis A in FIG. 2. Curve B shows the amplitude pattern with respect to the longitudinal oscillation, curve C shows the amplitude pattern with respect to the radial oscillation component and curve D shows the amplitude pattern with respect to expansion of the longitudinal oscillation. Around each expansion node is a con-centric band of a radially radiating surface. This active surface can be a multiple larger than that of a single acoustic transducer. If that concentric radiation surface is multiplied by the number of half-waves of the longitudinal oscillation, then it is easy to have an active radiation surface area which is larger than an entire battery of assembled individual acoustic transducers. At the same time however, this arrangement provides very good matching to the bath fluid of a single transducer.

The invention claimed is:

1. An ultrasonic treating device comprising:

an ultrasonic transducer with a solid resonator attached thereto, wherein at least one end of said resonator is connected to a front surface of the transducer at a point of a longitudinal oscillation maximum of said transducer, and wherein the length of the resonator is tuned to an integer multiple of half an acoustic wave length of the longitudinal oscillation, fed from the transducer to the resonator, for treating a liquid in an oil, gas or water well, wherein said transducer is attached to a matching transformer to transfer maximum power from a generator over a long cable with a length of 3 km up to 7 km to the transducer, and to adapt the generator to the impedance of the cable, the transducer, and the resonator, when located in said well, wherein the transducer energizes the resonator in a longitudinal wave mode.

2. The device according to claim 1, wherein said resonator is a round rod resonator with an operating frequency range of 10 kHz to 50 kHz.

3. A system for treating liquids in oil, gas or water wells, said system comprising an ultrasonic treatment device having a transducer with a solid resonator connected thereto, wherein at least one end of the resonator is connected to a front surface of the transducer at a point of longitudinal oscillation maximum of said transducer and wherein the length of the resonator is tuned to an integer multiple of half an acoustic wave length of the longitudinal oscillation fed from the transducer to the resonator, a generator for generating ultrasonic power with a voltage up to 2 kV, a cable for connecting said generator with said treatment device, wherein the treatment device further comprises an impedance matching transformer adapting the generator to the impedance of the cable, the transducer and the resonator.

4. A system according to claim 3, wherein said resonator is a round rod.

5. A system according to claim 3, wherein the matching transformer is arranged in a housing attached to the resonator.

6. A system according to claim 3, wherein the cable has a length of at least 3 km.

7. A system according to claim 3, wherein the system comprises a plurality of treatment devices having resonators of different shape.

8. A method for treating a liquid in a oil, gas or water well, comprising the steps of:

generating ultrasonic waves with an ultrasonic transducer having a solid resonator connected thereto, wherein at least one end of said resonator is connected to a front surface of the transducer at a point of a longitudinal oscillation maximum of said transducer, and wherein the length of the resonator is tuned to an integer multiple of half an acoustic length of the longitudinal oscillation fed from the transducer to the resonator, wherein the energy supplied to the transducer is maximized by a matching transformer adapting the generator to the impedance of the cable, the transducer and the resonator, and providing the liquid within said well with ultrasonic vibrations generated by said transducer and said resonator.

9. A method according to claim 8, said method comprising the step of supplying ultrasonic power from a generator through a cable having a length of at least 3 km.

* * * * *